United States Patent [19]

Hrivnak

[11] 4,035,934

[45] July 19, 1977

[54] ASSEMBLY SPIKE FOR ATHLETIC SHOE

[76] Inventor: Andrew N. Hrivnak, 56 Ball Ave., Yonkers, N.Y. 10701

[21] Appl. No.: 717,578

[22] Filed: Aug. 26, 1976

[51] Int. Cl.[2] ..... A43C 15/00; A43B 5/00

[52] U.S. Cl. ..... 36/67 D; 36/134

[58] Field of Search ..... 36/134, 67 D

[56] References Cited

U.S. PATENT DOCUMENTS

| | | | |
|---|---|---|---|
| 2,607,135 | 8/1952 | Langer | 36/67 D |
| 3,566,489 | 3/1971 | Morley | 36/67 D |

FOREIGN PATENT DOCUMENTS

| | | | |
|---|---|---|---|
| 714,531 | 9/1954 | United Kingdom | 36/67 D |

*Primary Examiner*—Patrick D. Lawson

*Attorney, Agent, or Firm*—Stanley J. Yavner

[57] ABSTRACT

An athletic shoe assembly for convenient removal and replacement of a spike therefor. The assembly includes an inner plate between the inner and outer soles of the shoe or between the inner sole and the heel of a shoe. Attached to the inner plate is a spike receiving member defining opposed slits in the sides thereof, into which protrudes opposed retaining springs anchored within the outer sole or heel of an athletic shoe. The spike assembly includes an outer plate, a spike member defining opposed removal channels and sealing means for preventing the clogging of the spike removal channels during use. A spike removal tool is also provided for disengaging the spike member after it has been used by insertion to the spike receiving member.

5 Claims, 5 Drawing Figures

ASSEMBLY SPIKE FOR ATHLETIC SHOE

This invention relates to a spike assembly for athletic shoes and more particularly to removable golf spikes for use in connection with golf shoes.

There are a number of removable athletic shoe spike constructions which have heretofore been tried and yet have proven to have many drawbacks. The main category of such prior art includes removable athletic shoe spikes wherein the spike is threadably engaged with a receiving chamber anchored to the shoe. These constructions are sturdy, but suffer from the disadvantages wherein the spike can be unintentionally disengaged during use. For instance, continuous turning motion applied to the spike during use can disengage the assembly. Also, the opposite problem can occur with such prior art constructions; namely, dirt and rust can make the spike extremely difficult to remove when replacement is desired.

Further, such prior art constructions are unnecessarily complex for their intended use.

Accordingly, a primary object of the present invention is to provide a spike assembly construction for use with athletic shoes;

A further object of the present invention is to provide an assembly of the type described which is simple and yet efficient in accomplishment of its purposes;

A still further object of the present invention is to provide an assembly of the type described wherein the spike is easily removed and replaced; and Another object of the present invention is to provide an assembly of the type described wherein the problems of clogging, rusting and jamming are eliminated.

These and other objects of the present invention are accomplished in an assembly which features an inner plate to which is attached a spike receiving member downwardly depending therefrom. The spike receiving member is generally elongated and defines side walls, which in turn define opposed slits. Attached at the exterior base of the spike receiving member are two opposed springs which extend upwardly into the slits in their normal orientation. A spike assembly is also provided wherein a spike member is arranged to protrude from an outer plate. The spike member is insertable for retention by the spike receiving member, wherein the springs are bent outwardly as the spike passes into the spike receiving member and the springs are arranged whereby they define shoulders registerable with a flange provided at the inner end of the spike member.

The assembly also features means by which dirt and other foreign matter are excluded from the inner parts of the assembly during use and the spike assembly defines removal channels to facilitate removal of the spike assembly from the spike receiving member. A removal tool is also provided for insertion to the removal channels for flexing the springs outwardly and engaging the spike member for removal and replacement.

The above brief description as well as further objects, features and advantages of the present invention will be more fully appreciated by reference to the following detailed description of the preferred, but nonetheless illustrative, embodiment when taken in conjunction with the accompanying drawing wherein.

Figure 1:
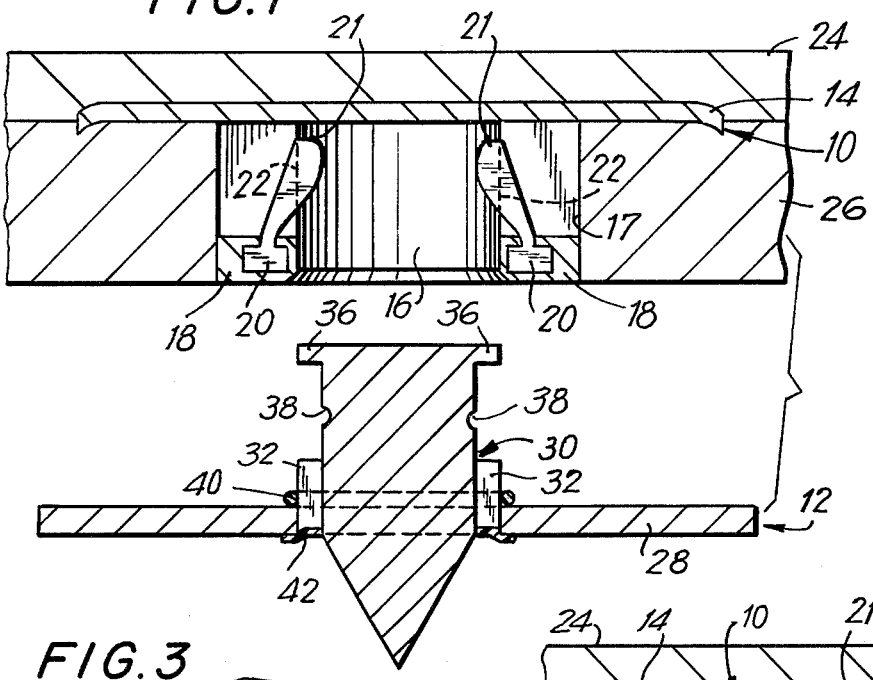
FIG. 1 is a side sectional view showing an exploded view of the construction of the present invention and particularly illustrating the spike receiving assembly and the spike assembly of the present invention.

Referring to the drawings, a construction according to the present invention is shown in FIGS. 1–4 as including a spike receiving assembly 10 and a spike assembly 12. Spike receiving assembly 10 includes an inner plate 14, downwardly depending from which is a generally cylindrical spike receiving member 16. Spike receiving assembly 10 also includes spring anchors 18 in which are embedded springs 20. The normal position of the springs is as shown in FIG. 1 wherein they protrude into spike receiving member 16 through slits 22 defined thereby.

It may be seen from the drawings that inner plate 14 essentially mounts the construction by its placement between an inner sole 24 and outer sole or heel 26. This arrangement also facilitates adapting the construction of the present invention to existing shoes, whereby after making a hole in outer sole or heel 26, inner plate 14 and the entire spike receiving assembly can be mounted through the hole before attaching the heel or outer sole 26 to inner sole 24.

Spike assembly 12 includes outer plate 28 from which protrudes spike member 30. Spike member 30 has mounting base members 32 on either side thereof, with such base members defining channels 34 (FIG. 3), whose function will be hereinafter described. Also, the spike member 30 defines a top flange 36 which interacts with springs 20 for locking spike assembly 12 into spike receiving assembly 10. Furthermore, spike member 30 defines indentations 38 for facilitating removal of spike assembly 12 from spike receiving assembly 10.

Figure 2:
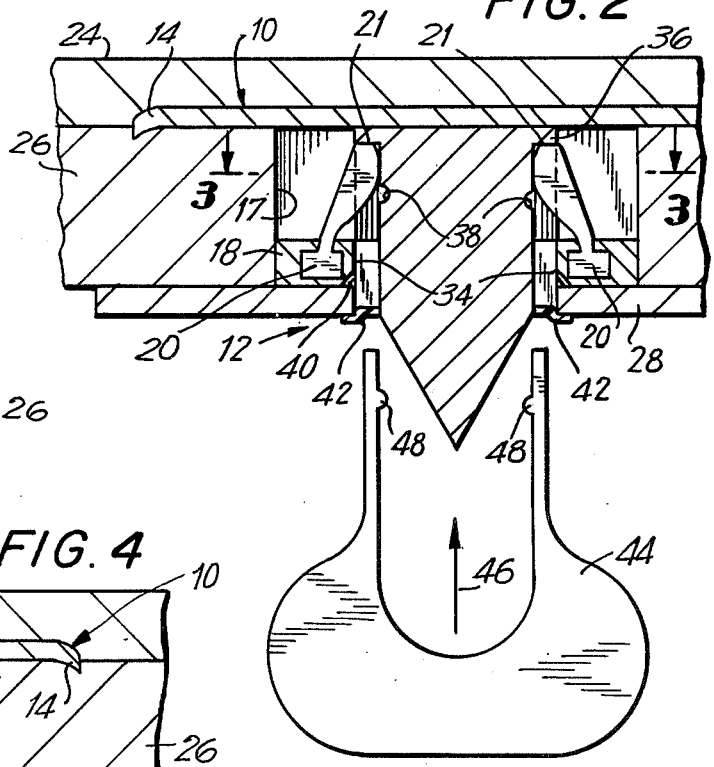
FIG. 2 is a sectional view of the construction of the present invention, showing particularly the construction in place for use and illustrating the removal capability for the spike assembly.

Referring particularly to FIG. 2, spike assembly 12 is shown in mounted position with respect to spike receiving assembly 10. It may be seen that in this position, O-ring 40 and temporary plastic seals 42 prevent jamming and other problems caused by dirt and the like entering the assembly. Removal of spike assembly 12 for replacement is accomplished by the use of removal tool 44 being inserted in the direction depicted by arrow 46. Removal tool 44 pierces temporary plastic seals 42, moves upwardly along channels 34 and engages indentations 38 by means of grasping protrusions 48 extending from the legs of removal tool 44.

Figure 4:
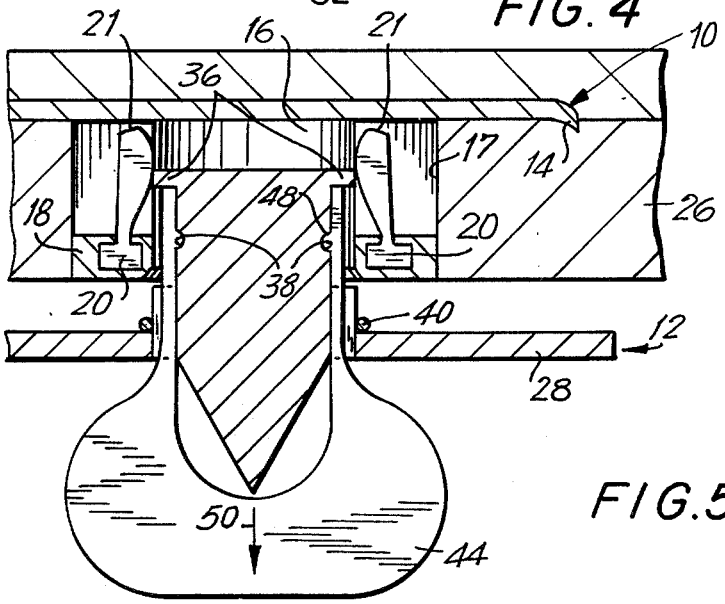
FIG. 4 is a sectional view similar to that shown in FIG. 2, but with the spike assembly slightly removed from the spike receiving assembly by means of a removal tool.

Referring to FIG. 4, after registration between grasping protrusion 48 and indentation 38, motion of removal tool 44 in direction 50 will remove spike assembly 12 from spike receiving assembly 10.

Insertion of a new spike assembly is accomplished in a like manner by reversing the procedure. It should be noted that the new assembly will include the same temporary plastic seals 42 in order to provide the construction with the same safeguards against clogging and other jamming hazards.

Figure 3:
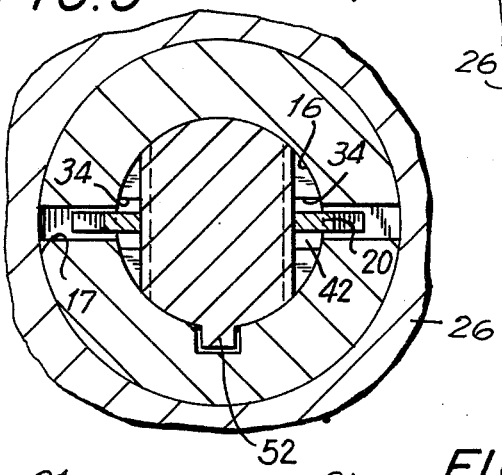
FIG. 3 is a top sectional view taken along the line 3—3 of FIG. 2 showing particularly the locking mechanism for the construction of the present invention.

Referring particularly to FIG. 3, it may be seen that an anti-rotative feature is also included wherein protrusion 52 is provided in the side wall of spike member 30 in order to lock it against rotative motion.

Figure 5:
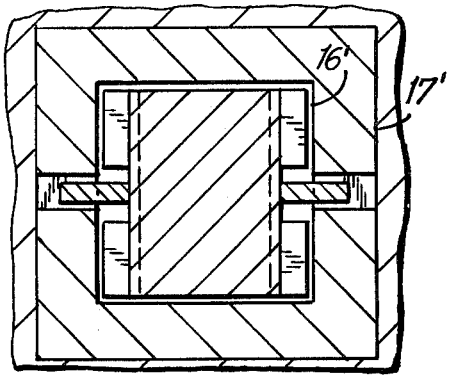
FIG. 5 is a sectional view similar to that of FIG. 3, but illustrating an alternative embodiment of the present invention wherein the spike receiving assembly is primarily of a square rather than a round configuration.

An alternative embodiment of the present invention is shown in FIG. 5 wherein spike receiving member 16′ is provided in a square rather than a circular cross section. Furthermore, the outer walls 17′ of spike receiving assembly 10 are also in a square configuration rather than the round configuration shown in FIG. 1.

In order to provide a more complete description of the present invention, a series of use and operational steps will now be described. Initially, if an existing shoe is to be provided with the features of the present invention, the heel or outer sole 26 of such shoe is worked to define outer configuration 17 or 17′ of spike receiving assembly 10. This may be accomplished by simply working heel or outer sole 26 to define a hole therein. Inner plate member 14 is then used, with spike receiving member 16 attached, to cover the inner face of that hole. The balance of spike receiving assembly 10 is provided by spring anchors 18 and springs 20 fitting into slits 22 defined by spike receiving member 16. Either by use of removal tool 44 or without such took, spike assembly 12 is inserted with flanges 36 forcing springs 20 apart. Upon full insertion, springs 20 will return to their normal position and their top shoulders 21 will register with flanges 36 in order to retain spike assembly 12 in place. Full insertion will cause outer plate member 28 to abut the bottom face of heel or outer sole 26 with O-ring 40 providing a seal against dirt and the like. Furthermore, temporary plastic seals 42 will prevent clogging through removal channels 34.

Removal of spike assembly 12 is accomplished by inserting removal tool 44 in direction 46 as shown in FIG. 2, whereby grasping protrusions 48 mate with indentations 38 as the legs of removal tool 44 spread springs 20. Removal tool 44 is then withdrawn in direction 50 as shown in FIG. 4 and spike assembly 12 is thereby removed for replacement.

As a further alternative embodiment, it may be seen, particularly with reference to FIGS. 1, 2 and 4, that spring anchors 18 may be eliminated by inverting springs 20 and anchoring them from inner plate member 14. With still upwardly facing shoulders 21, this alternative structure provides an efficient construction for accomplishing the purposes of the present invention.

What is claimed is:

1. An athletic shoe spike construction comprising a spike receiving assembly and a spike assembly, said spike receiving assembly including a spike receiving member defining opposed side slits and a pair of opposed springs each defining a top-shoulder normally protruding into said spike receiving member through said slits and said spike assembly including a spike member defining side spike removal channels and a top flange, said spike member being insertable and removable to said spike receiving member with insertion by passing into said spike receiving member, said top flange moving said springs apart and said top flange on said top shoulders to retain said spike member is fully inserted position with respect to said spike receiving member.

2. An athletic shoe spike construction comprising a spike receiving assembly and a spike assembly, said spike receiving assembly including a spike receiving member defining opposed side slits and a pair of opposed springs each defining a top-shoulder normally protruding into said spike receiving member through said slits and said spike assembly including a spike member defining side spike removal channels and a top flange, said spike member being insertable and removable to said spike receiving member with insertion by passing into said spike receiving member, said top flange moving said springs apart and said top flange resting on said top shoulders to retain said spike member in fully inserted position with respect to said spike receiving member, with said spike member further defining a protrusion in its side wall for locking said spike member against rotating motion.

3. An athletic shoe spike construction comprising a spike receiving assembly and a spike assembly, said spike receiving assembly including a spike receiving member defining opposed side slits and a pair of opposed springs each defining a top-shoulder normally protruding into said spike receiving member through said slits and said spike assembly including a spike member defining side spike removal channels and a top flange, said spike member being insertable and removable to said spike receiving member with insertion by passing into said spike receiving member, said top flange moving said springs apart and said top flange resting on said top shoulders to retain said spike member in fully inserted position with respect to said spike receiving member, wherein spring anchors are provided at the exterior base of said spike receiving member to provide a restraint for said springs.

4. An athletic shoe spike construction comprising a spike receiving assembly and a spike assembly, said spike receiving assembly including a spike receiving member defining opposed side slits and a pair of opposed springs each defining a top-shoulder normally protruding into said spike receiving member through said slits and said spike assembly including a spike member defining side spike removal channels and a top flange, said spike member being insertable and removable to said spike receiving member with insertion by passing into said spike receiving member, said top flange moving said springs apart and said top flange resting on said top shoulders to retain said spike member in fully inserted position with respect to said spike receiving member, wherein said spike assembly further includes an outer plate for reinforcing said construction and for preventing clogging of said spike receiving member and wherein an O-ring is provided between said spike member and said outer plate for sealing the construction during use, a temporary plastic seal being provided between said outer plate and said spike member to seal said channels during use of the construction and a removal tool being provided to pierce said plastic seal, move along said channels and more said springs apart to facilitate removal of said spike member.

5. The invention according to claim 4 wherein said spike member defines indentations and said removal tool defines grasping protrusions for registration therebetween when said tool is fully inserted to said spike receiving member for removal of said spike member.

* * * * *